US005563454A

United States Patent [19]

Araki et al.

[11] Patent Number: 5,563,454

[45] Date of Patent: Oct. 8, 1996

[54] STARTING APPARATUS FOR VEHICLES USING A SUBSIDIARY STORAGE DEVICE

[75] Inventors: Takeshi Araki, Nishikasugai-gun; Yasuhiro Nagao, Okazaki, both of Japan

[73] Assignee: Nippondenso Co., Ltd., Kariya, Japan

[21] Appl. No.: 260,749

[22] Filed: Jun. 15, 1994

[30] Foreign Application Priority Data

Jun. 25, 1993 [JP] Japan ..... 5-155123

[51] Int. Cl.[6] ..... F02N 11/00

[52] U.S. Cl. ..... 307/10.6; 123/179.1; 290/38 R

[58] Field of Search ..... 307/9.1, 10.1, 307/10.6, 109, 110, 10.3; 123/179.1, 179.25, 179.3, 179.28; 320/1, 2, 6, 15, 61–64; 290/27, 28, 36 R, 47, 48, 38 R, 50; 361/160, 189, 154, 194

[56] References Cited

U.S. PATENT DOCUMENTS

| | | | |
|---|---|---|---|
| 2,695,378 | 11/1954 | Irvin | 361/160 |
| 4,283,748 | 8/1981 | Gotoh | 361/154 |
| 4,896,637 | 1/1990 | Yamamoto | 290/38 R |
| 5,041,776 | 8/1991 | Shirata et al. | 290/38 R |
| 5,146,095 | 9/1992 | Tsuchiya et al. | 290/38 R |
| 5,155,373 | 10/1992 | Tsuchiya et al. | 123/179.1 |
| 5,155,374 | 10/1992 | Shirata et al. | 123/179.1 |
| 5,157,267 | 10/1992 | Shirata et al. | 123/179.3 |
| 5,207,194 | 5/1993 | Clerici | 123/179.1 |
| 5,256,956 | 10/1993 | Tsuchiya et al. | 320/15 |

FOREIGN PATENT DOCUMENTS

| | | |
|---|---|---|
| 2-175351 | 7/1990 | Japan . |
| 2-175350 | 7/1990 | Japan . |
| 2-259277 | 10/1990 | Japan . |
| 2-259276 | 10/1990 | Japan . |
| 3-23370 | 1/1991 | Japan . |

*Primary Examiner*—William M. Shoop, Jr.
*Assistant Examiner*—Richard T. Elms
*Attorney, Agent, or Firm*—Cushman Darby & Cushman

[57] ABSTRACT

A starting apparatus which is capable of preventing damages to the starter unit even if a starting current passed to the starter unit fails to be interrupted due to switch troubles, etc. is provided. A main storage device is charged by a power generating device and feeds electricity to electric loads in a vehicle and a subsidiary storage device. A starting switch passes the charging current from the main storage device to the subsidiary storage device during non-starting time, by which the subsidiary storage device specially designed to drive the starter unit stores the power which is smaller than that which may cause damages such as burning to the starter unit even if the current is discharged continuously to the starter unit, but larger than that required for each starting under normal conditions. The starting switch discharges the power stored in the subsidiary storage unit to a coil of a magnet switch of the starter unit to close the magnet switch, whereby the starting power is fed from the main storage unit to the starter motor of the starter unit.

23 Claims, 11 Drawing Sheets

STARTING APPARATUS FOR VEHICLES USING A SUBSIDIARY STORAGE DEVICE

BACKGROUND OF THE INVENTION

1. Field of the Invention

The present invention relates to a starting apparatus for vehicles.

2. Description of Related Art

A conventional example of a starting apparatus for vehicles is illustrated in FIG. 20.

In this apparatus, when a switch (starting switch) 6 is closed, a current is passed from a battery 1 through a coil of a magnet switch 40 of a starter unit 4, whereby a contact thereof is closed, a starter motor M starts to run, and an engine (not shown) is started.

However, in the above starting apparatus, if, after the switch 6 is turned on to actuate the starter unit 4 with a magnet switch 40, the switch 6 is not turned off for some reason, the starter motor M will continue running and may burn up.

Moreover, if an operator fails to start the engine by turning the switch 6 on, he will turn the switch 6 off. Then the starter unit 4 will release a pinion thereof (not shown) from a ring gear of the engine (not shown), and the starter motor M will coast (keep running) for a while and then stop. Under such a situation, the operator will, so as to start the engine, turn the switch 6 on again to engage the pinion with the ring gear. However, if the coasting of the starter motor M has not completely stopped, an excessive shock might be generated which may damage the starter and the engine (re-jump-in damage).

Moreover, if, after the switch 6 is turned on to start the starter unit 4, the magnet switch 40 is not deactuated for some reason, the starter motor M will continue running and may burn up.

SUMMARY OF THE INVENTION

The present invention takes the above-mentioned problems into consideration, and its object is to provide a starting apparatus for vehicles which can prevent damages to a starter unit even in the case of failure in interrupting electric current passed to a starter unit due to switch troubles, etc.

The starting apparatus for vehicles of the present invention includes: a starter unit having a starter motor which starts an engine and a magnet switch which controls a flow/non-flow of a current passed to the starter motor; a subsidiary storage device which is specially designed to drive the starter unit and capable of storing electric power less than that which may cause damages such as burning to the starter unit when a continuous discharging is made to said starter unit, but more than that required for each starting of the engine; a main storage device which is charged by an electric power generating device driven by the engine and which feeds electricity to electric loads in a vehicle and the subsidiary storage device; and a starting switch which feeds a driving power to, at least, a coil of the magnet switch by discharging the power stored in the subsidiary storage device to the starter unit at engine starting, and on the other hand, passes to the subsidiary storage unit the electricity for charging from the main storage device at non-starting of the engine.

The main storage device is charged by the power generating apparatus driven by the engine and feeds electricity to the electric loads in the vehicle and the subsidiary storage device. The starting switch passes, at non-starting time, to the subsidiary storage device the electricity from the main storage device. The subsidiary storage device which is specially designed to drive the starter unit stores the electric power less than that which may cause damages such as burning to the starter unit even if discharging to the starter unit is continuously made, and more than that required for each starting under normal conditions.

In one structural aspect, the starting switch discharges, at engine starting, electric power stored in the subsidiary storage device to the coil of the magnet switch of the starter unit to close the magnet switch, whereby starting power is fed from the main storage device to the starter motor of the starter unit.

In another structural aspect, the starting switch discharges, at starting, electric power stored in the subsidiary storage device to the coil of the magnet switch of the starter unit to close the magnet switch, whereby starting power is fed from the subsidiary storage device to the starter motor of the starter unit.

Accordingly, the starting apparatus for vehicles of the present invention attains the following advantages.

First, even if the starting switch fails to be shifted into "off" position and electric power is continuously fed from the subsidiary storage device to the magnet switch and the starter motor, the magnet switch and the starter motor of the starter unit will not suffer any damage such as burning, and, moreover, no power will be wasted and no restart failures will occur because the capacity of the subsidiary storage device is small.

Meanwhile, even if the starting switch works normally, when the coil of the magnet switch fails due to a short circuit or grounded fault, an excessive current will be passed and rapidly heat the coil, possibly resulting in damages such as burning in the case of conventional apparatus. However, here, the apparatus of the present invention will prevent burning and reduce waste of power even under such situation because of such a small capacity of the subsidiary storage device. Similarly, even when the starter motor and, in particular, a commutator fails due to a short circuit or grounding fault, the apparatus of the present invention will also stop burning and reduce waste of power for the same reason.

Thirdly, since the subsidiary storage device of the present invention is specially designed to feed electricity to the starter unit, it only needs to store the capacity of electric power for starting. That is, in some cases, the capacity of electric power is determined to a value required to keep closing the contact of the magnet switch for a given time (several seconds, for example) required for normal starting, and in other cases the capacity of electric power is determined to a value required for feeding electric power to the starter motor and the magnet switch for a given time (several seconds, for example) required for normal starting. Thus, the capacity of the subsidiary storage unit can be reduced, and accordingly, its mountability can be improved.

Fourthly, if an operator who is not skilled enough, for instance, keeps the starting switch on for a long time or turns it on frequently at short intervals, the terminal voltage of the subsidiary storage device rapidly drops to prevent such an action, whereby wasting of stored electricity can be prevented.

In the case in which electricity is fed by the subsidiary storage device (e.g., electric double-layer condenser) to both of the starter unit and the electric loads in the vehicle, in comparison with the structure and operation of the present invention mentioned above, the power consumption of the electric loads in the vehicle is larger, and thus the subsidiary storage device should be larger in size and capacity. If the subsidiary storage device with such a large capacity has troubles such as a failure of the starting switch, a short circuit or grounding fault of the magnet switch or the starter motor, a large volume of current will flow through the magnet switch or the starter motor in a short time, and also a large volume of electric power will be wasted and it will become difficult to restart the starter motor. Such a fault will not happen in the apparatus of the present invention wherein the subsidiary storage device feeds no electricity to the electric loads in the vehicle.

DETAILED DESCRIPTION OF THE PREFERRED EMBODIMENTS

Figure 1:
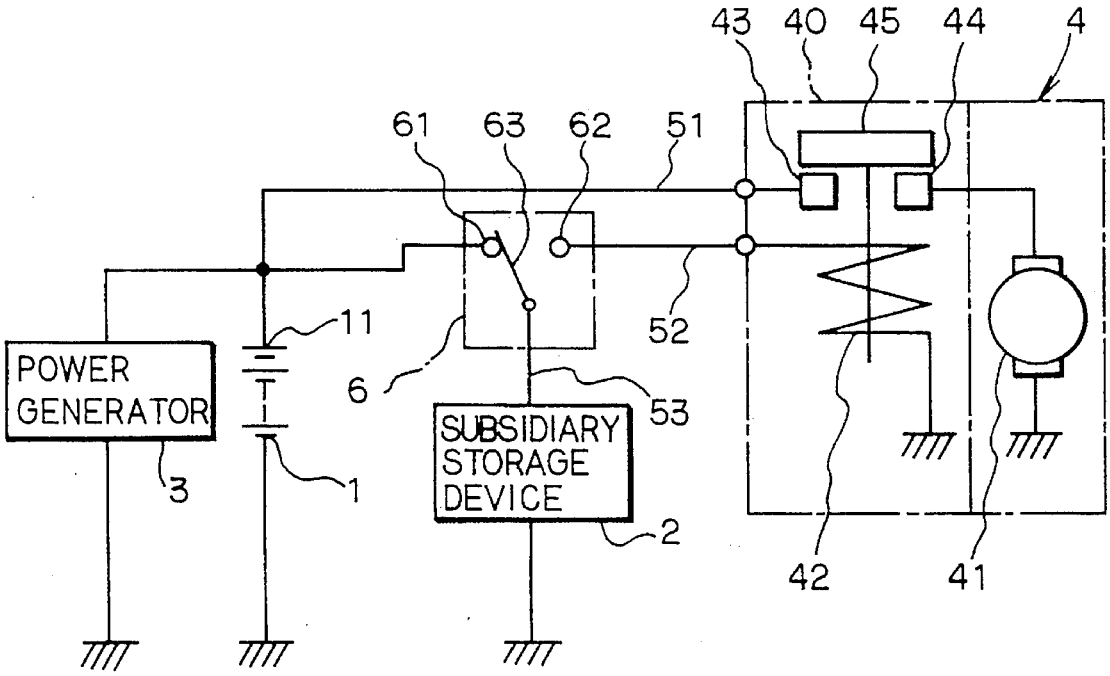
FIG. 1 is a circuit diagram illustrating a first embodiment according to the present invention.

Embodiments according to the present invention will now be described referring to the drawings attached hereto.

The first embodiment according to the present invention will now be described with reference to FIG. 1.

Numeral 1 designates a battery which constitutes a main storage device of a vehicle, 2 a subsidiary storage device exclusive for a magnet switch of a starter, 3 an electric power generating device of the vehicle, and 4 a starter unit. Numeral 41 designates a starter motor, 40 a magnet switch, 42 an exciting coil of the magnet switch, 43 and 44 fixed contacts of the magnet switch, 45 a moving contact thereof, 51, 52 and 53 harnesses, 6 a starting switch, 61 and 62 transfer contacts, and 63 a common contact. The contacts 61 and 63 are normally closed, and the contacts 62 and 63 are normally open.

Description of operation will now be made. When an engine (not shown) is at rest or is running, the contacts 61 and 63 of the switch 6 are normally in a "closed" condition (that is, the switch 6 is OFF) and the subsidiary storage device 2 is kept fully charged by the battery 1 and the electric power generating device 3.

When an operator sets the contacts 62 and 63 of the switch 6 into the "closed" position (that is, the switch 6 is ON) to start the engine, the higher potential end 53 of the subsidiary storage device 2 is connected to the exciting coil 42 of the magnet switch 40 and an electric current flows through the exciting coil 42, whereby the fixed contacts 43 and 44 are closed by the moving contact 45. At the same time, a pinion (not shown) of the starter is engaged with a ring gear (not shown) of the engine. This causes the starter motor 41 to be actuated and the engine to be started via the pinion and the ring gear.

When the engine comes into operation or starts to run, the operator turns the switch 6 off, by which the current passed through the exciting coil 42 is interrupted and the connection between contacts 43 and 44 is cut, thus releasing the pinion from the ring gear. At the same time the electricity fed to the motor 41 is interrupted, and the motor 41 stops after coasting for a while. Then, the subsidiary storage device 2 is connected again to the battery 1 and the generating device 3 to be charged again.

The characteristics of the embodiment will now be described.

In case that the switch 6 fails to be deactuated in the above-mentioned operation for some reason, the subsidiary storage device 2 continues to feed electricity to the exciting coil 42, but the voltage of the subsidiary storage device 2 drops gradually by discharge, below a restorative voltage (which is the voltage for returning the contacts 43 and 44 into the closed condition). Thus, the contacts 43 and 44 will be opened and the electricity fed to the motor 41 will be interrupted, releasing the pinion from the ring gear.

The time T1 from when the switch 6 is turned on to when the voltage of the subsidiary storage device 2 falls below the restorative voltage of the magnet switch 40 can be set as desired via the capacity of the subsidiary storage device 2. Burning can be prevented by setting the time T1 to be shorter (5 to 60 seconds, for example) than a time T2 by which the motor 41 and/or the magnet switch 40 burns up. Similarly, damages which are caused by troubles due to short-circuits and/or grounding fault inside the magnet switch 40 and/or the starter motor 41 can be minimized.

The subsidiary storage device 2 may be a lead battery which is a conventional power source for vehicles or some other type of secondary battery such as a lithium battery. Various types of condensers (capacitors) such as an electric double-layer condenser can be also used for the subsidiary storage device 2.

Figure 2:
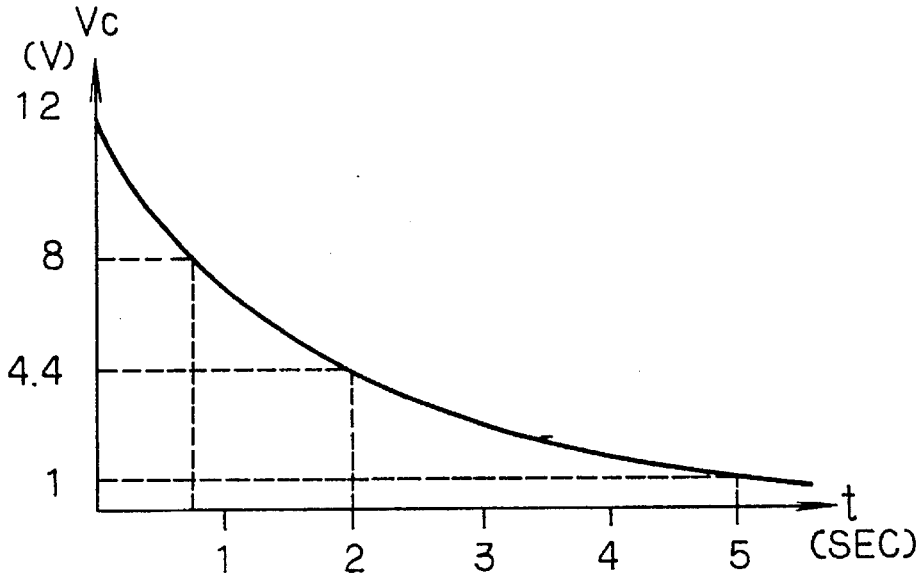
FIG. 2 is a discharge characteristic diagram of an electric double-layer condenser.
Figure 3:
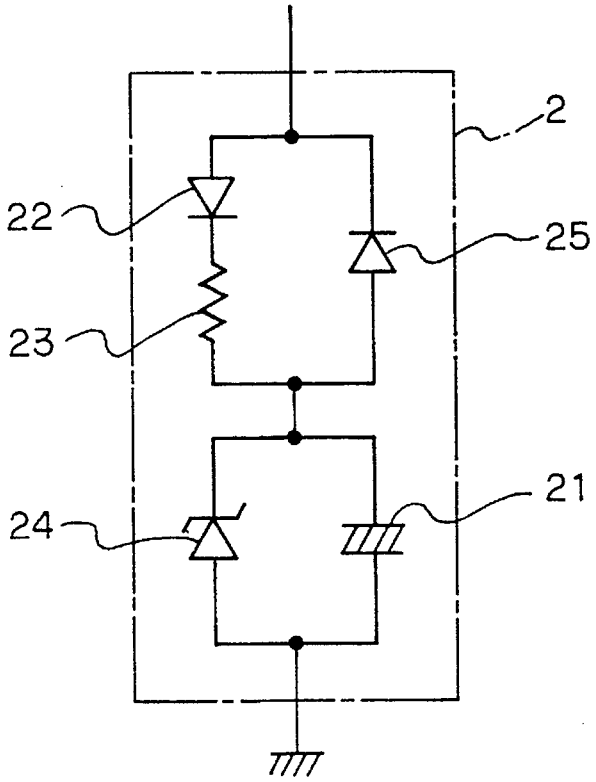
FIG. 3 is a circuit diagram of a subsidiary storage device.

When the electric double-layer condenser is used as storing unit inside the subsidiary storage device 2, the circuit structure of the subsidiary storage device 2 is illustrated in FIG. 3 and the discharge characteristic of the subsidiary storage device 2 is shown in FIG. 2. While the electric double-layer condenser 21 is charged, an electric current flows through a diode 22 and a resistor 23, and during discharge, the current flows through a diode 25. In addition, a Zener diode 24 helps keep the voltage of the electric double-layer condenser 21 being charged below a given value.

On the assumption that the initial voltage of the subsidiary storage device 2 is 12 V (volts), the capacity of the electric double-layer condenser 21 is 6.7 F (farads), and the resistance of the exciting coil 42 is 0.3Ω (ohm), then the terminal voltage of the subsidiary storage device 2 is expressed as follows with the internal equivalent electric resistance of the subsidiary storage device 2 being ignored here.

$$Vc=12\exp\{-t/(0.3\times 6.7)\} \quad [V]$$

If the operating voltage of the magnet switch 40 is set to 8 V and the restorative voltage to 1 V, then the terminal voltage of the subsidiary storage device 2 will fall below the restorative voltage of the magnet switch 40 after five seconds, at which time the starter 4 will stop running and burning will be prevented.

The effect of preventing re-jump-in damages will now be described, taking as an example the case in which the above-mentioned electric double-layer condenser 21 is used.

If an operator turns the switch 6 on to start the engine but the engine does not start running and he turns the switch 6 off after two seconds, the terminal voltage of the subsidiary storage device 2 is 4.4 V at that time, whereby, even if the operator turns the switch 6 on again immediately after turning the same off, the starter 4 will not be actuated for a period of time T3 in which the subsidiary storage device 2 is charged to the operating voltage of 8 V.

Accordingly, if the time T3 is set to be longer (one to five seconds, for example) than T4 which is a period of time required for the motor 41 to completely stop after coasting, the starter 4 will not be actuated while the motor 41 is coasting and, accordingly, re-jump-in damages can be prevented.

The time T3 can be set as desired by varying the value of the charging resistor 23. If, for example, the resistance is set to 0.7Ω, the time T3 will be about three seconds with the internal equivalent electric resistance of the subsidiary storage device 2 being ignored in this case, too.

The same effect as that of the embodiment described above can be obtained not only by the use of the electric double-layer condenser 21 but also by using secondary batteries and condensers which possess similar discharge drooping characteristics as those shown in FIG. 2.

The second embodiment will now be described with reference to FIG. 4.

This embodiment differs in that the exciting coil 42 of the magnet switch 40 is a two-coil configuration instead of the one-coil configuration applied in the first embodiment. That is, the contact 62 is connected to an intermediate tap of the exciting coil 42, the higher potential end of the exciting coil 42 is connected to the anode of a diode 7, and the cathode of the diode 7 is connected to the fixed contact 44.

This second embodiment works as follows. When the contacts 62 and 63 are closed to actuate the starter unit 4, current flows from the above-mentioned intermediate tap of the exciting coil 42 to the grounded side and to the starter motor M side, and the magnet switch 40 is turned on by the flux caused by the current thus, actuating the starter motor 41. It is to be noted that an electric potential of the battery 1 is also applied to the starter motor 41 when the magnet switch 40 is turned on. Therefore, the diode 7 is added to prevent a reverse flow of current from the contact 44 to the contact 62.

A third embodiment will now be explained with reference to FIG. 5.

In this embodiment, the resistor 23 (refer to FIG. 3) for determining the time constant of charging at the magnet switch 40 of one-coil configuration applied in the first embodiment is disposed between the higher potential end 11 of the battery 1 and the contact 61 of the starting switch 6.

This allows the subsidiary storage device 2 to be composed only of the electric double-layer condenser 21, thus eliminating the diodes 22 and 25 illustrated in FIG. 3. It is to be noted that the circuit structure of this embodiment can be, of course, applied to the magnet switch 40 of two-coil configuration described in the second embodiment.

The fourth and fifth embodiments will now be described with reference to FIGS. 6 and 7 respectively.

Figure 6:
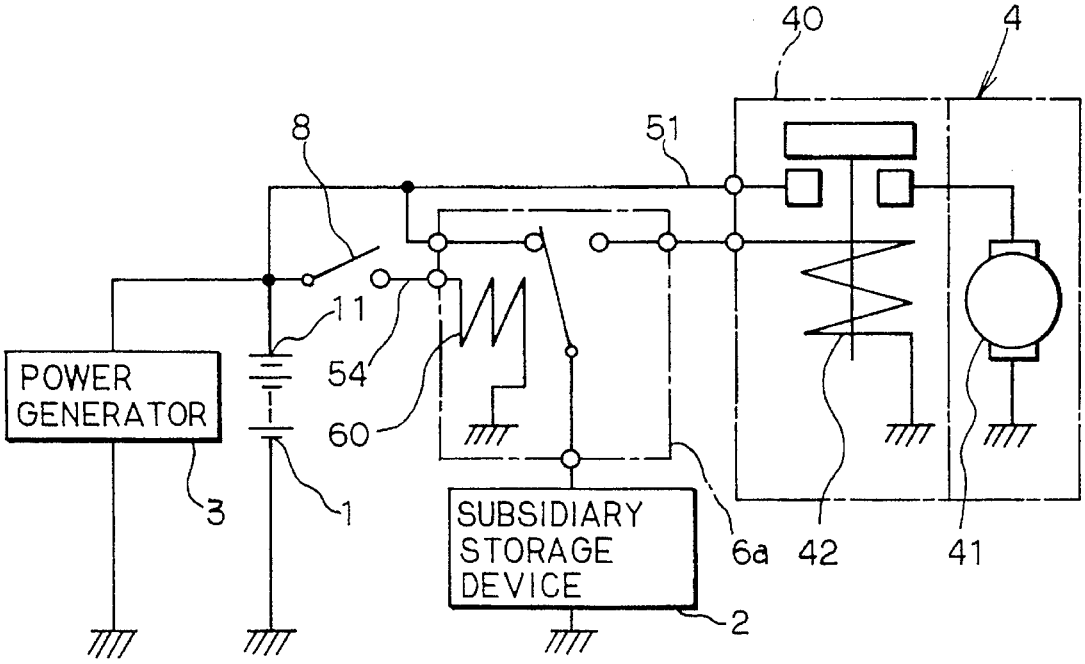
FIG. 6 is a circuit diagram illustrating a fourth embodiment according to the present invention.

In this embodiment shown in FIG. 6, the starting switch 6 composed of a manual transfer switch applied in the first embodiment is replaced by a relay drive type transfer switch **6*a*, and for driving the switch 6*a*, an electricity is fed from the higher potential end 11 of the battery 1 through a switch 8 to an exciting coil 60 of the switch 6*a*** so that the same effect as in the first embodiment can be attained.

Figure 7:
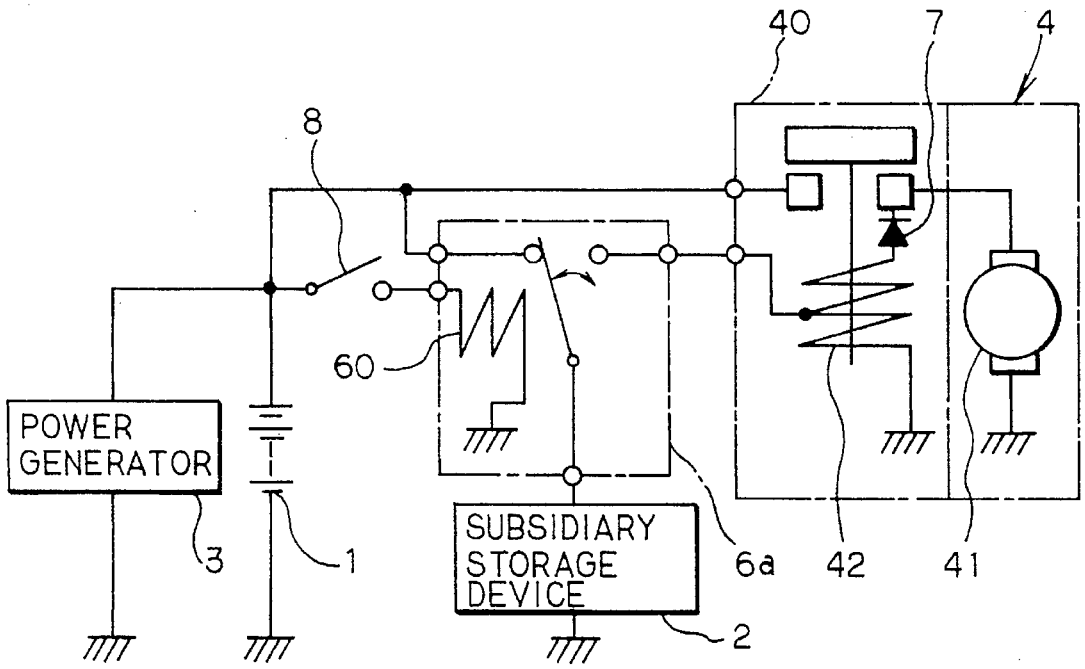
FIG. 7 is a circuit diagram illustrating a fifth embodiment according to the present invention.

FIG. 7 shows an application of the circuit structure illustrated in FIG. 6 to the magnet switch 40 of the two-coil configuration.

The sixth embodiment will now be described with reference to FIG. 8.

This embodiment employs an internal circuit structure of the subsidiary storage device 2 in a way different from that illustrated in FIG. 3. A booster circuit 26 composed of a DC-DC converter is provided in the anode side of the diode 22 for charging illustrated in FIG. 3.

Such an arrangement allows the battery voltage applied from the higher potential end 11 of the battery 1 to the booster circuit 26 to be first boosted to a given voltage and then applied to the electric double-layer condenser 21. This helps reduce the diameters of the harnesses 52 and 53 and also the heat produced in the exciting coil 42 of the magnet switch 40.

Figure 8:
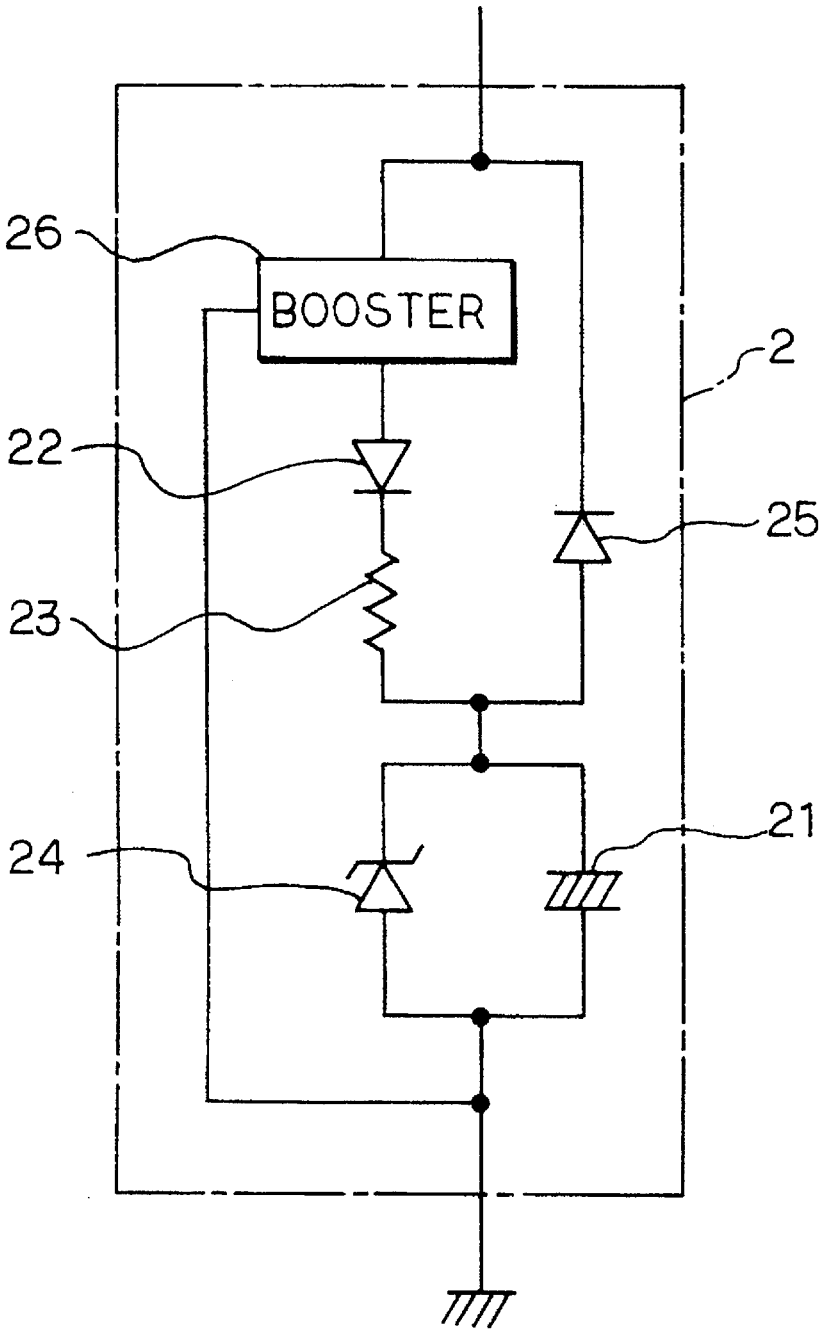
FIG. 8 is a circuit diagram of a sixth embodiment according to the present invention.

If the booster circuit 26 composed of the DC-DC converter employed in the embodiment is provided between the higher potential end 11 of the battery 1 and the resistor 23, the diodes 22 and 25 illustrated in FIG. 8 can be eliminated.

Figure 9:
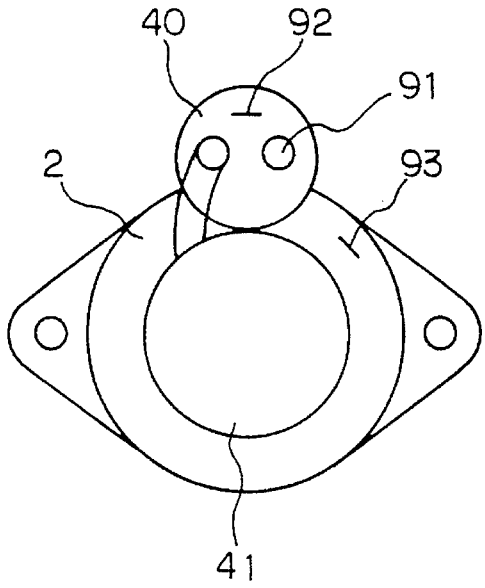
FIG. 9 is a side view illustrating a first layout example of the starting apparatus for vehicles of the present invention.
Figure 10:
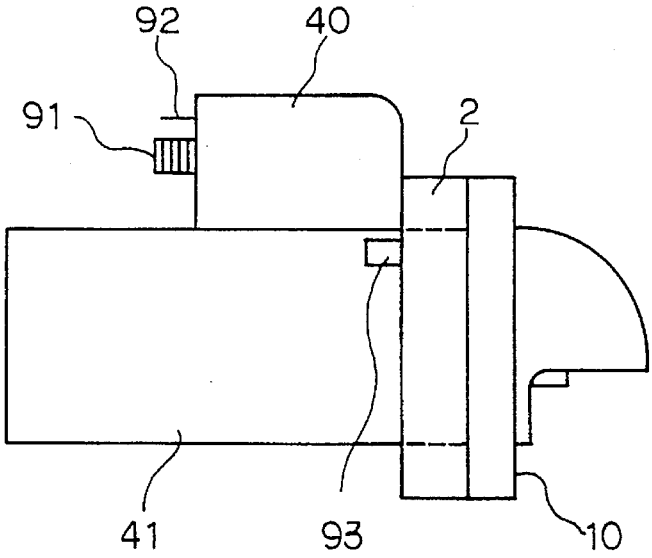
FIG. 10 is a front view illustrating the apparatus illustrated in FIG. 9.

Next, the layout of the apparatus will now be described with reference to FIGS. 9 and 10.

This first layout shows an application of the first and second embodiments, in which the subsidiary storage device 2 is mounted on the starter unit 4. The subsidiary storage device 2 is constructed in the form of a ring and mounted on an engine mounting plate 10 for resisting vibration. Terminals 91, 92 and 93 will be connected respectively to harnesses 51, 52 and 53. This arrangement allows the number of harnesses attached when assembling onto a vehicle body (not shown) to be reduced to two to three wiring cables thus, reducing the man-power for installation work.

Figure 11:
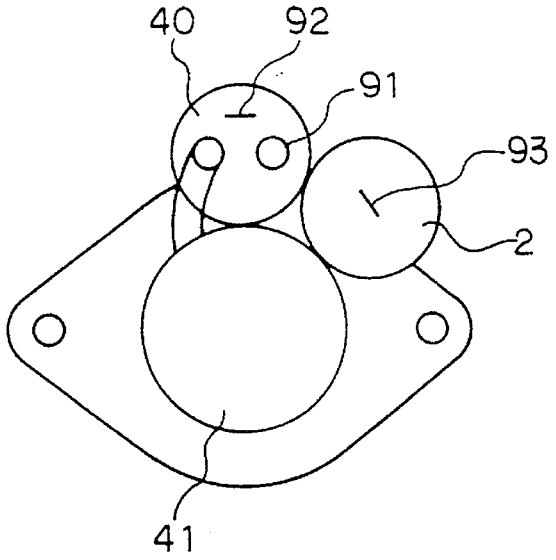
FIG. 11 is a side view illustrating a second layout example of the starting apparatus for vehicles of the present invention.
Figure 12:
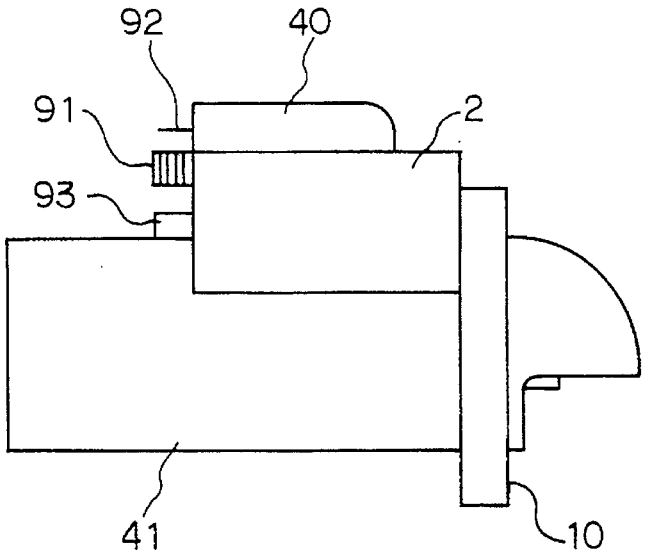
FIG. 12 is a front view illustrating the apparatus illustrated in FIG. 11.

The second layout example will now be described with reference to FIGS. 11 and 12.

In this layout, the subsidiary storage device 2 is constructed in the form of a cylinder and mounted on the engine mounting plate 10 in the same way as above.

Figure 13:
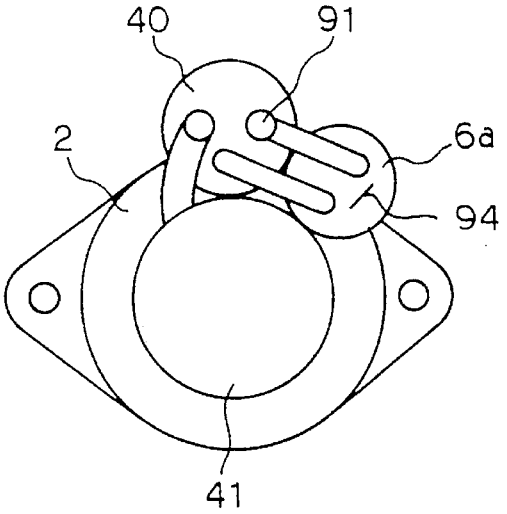
FIG. 13 is a side view illustrating a third layout example of the starting apparatus for vehicles of the present invention.
Figure 14:
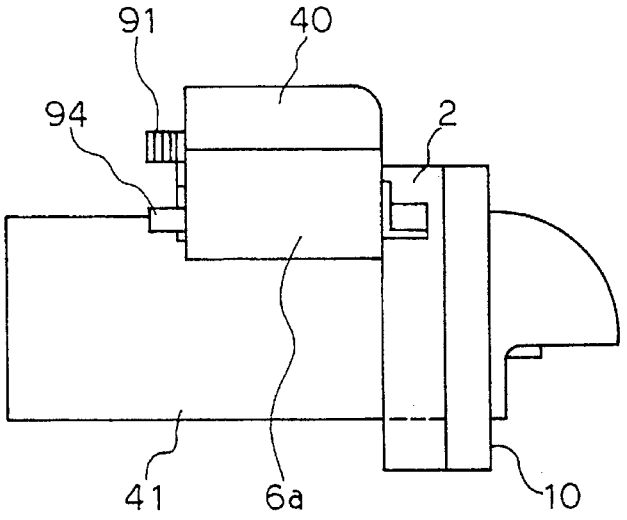
FIG. 14 is a front view illustrating the apparatus illustrated in FIG. 13.

The third layout example will now be described with reference to FIGS. 13 and 14.

This layout is a mounting example of the case in which the relay drive type transfer switch 6a illustrated in FIGS. 6 and 7 is adopted. The subsidiary storage device 2 is constructed in the form of a ring and mounted on the engine mounting plate 10 for avoiding vibration. In addition, the relay drive type transfer switch 6a is provided adjacent to the magnet switch 40. The terminals 91 and 94 will be connected respectively to harnesses 51 and 54.

Such an arrangement allows the electric wiring between the subsidiary storage device 2 and the magnet switch 40 to be shortened and also the voltage applied to the magnet switch 40 to be kept higher.

Figure 15:
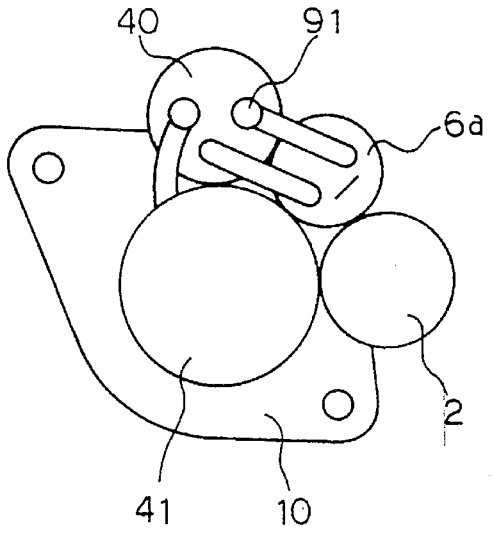
FIG. 15 is a side view illustrating a fourth layout example of the starting apparatus for vehicles of the present invention.
Figure 16:
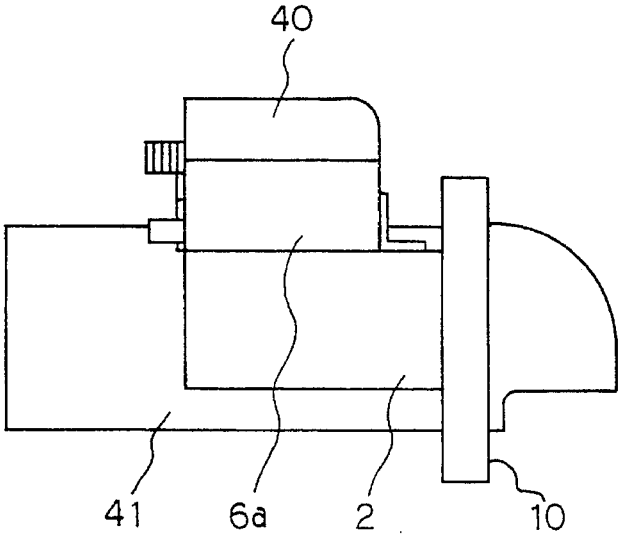
FIG. 16 is a front view illustrating the apparatus illustrated in FIG. 15.

The fourth layout example is now described with reference to FIGS. 15 and 16.

In this example, the subsidiary storage device 2 is constructed in the form of a cylinder and mounted on the engine mounting plate 10 in the same way as the above.

Figure 17:
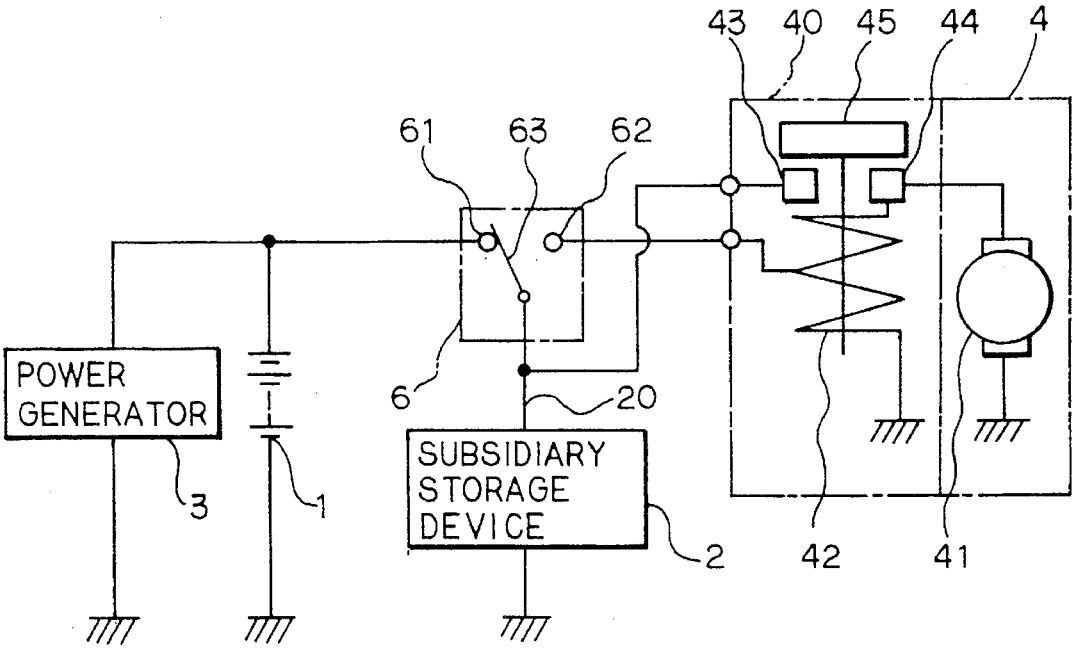
FIG. 17 is a circuit diagram illustrating a seventh embodiment according to the present invention.

The seventh embodiment will now be described with reference to FIG. 17.

Figure 5:
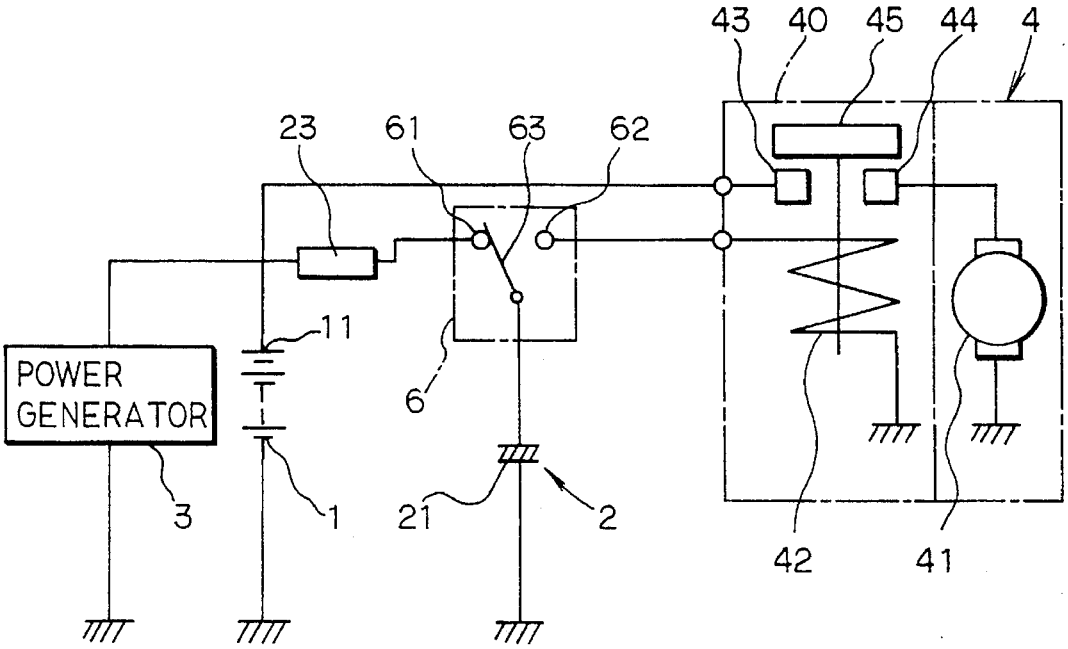
FIG. 5 is a circuit diagram illustrating a third embodiment according to the present invention.

This embodiment shows a modification of the embodiments illustrated in FIGS. 1, 5 and 6, in which the contact 43 of the magnet switch 40 is connected to a higher potential end 20 of the subsidiary storage device 2 so that the starter motor 41 is supplied with electricity exclusively from the subsidiary storage device 2.

In this embodiment, burning of the magnet switch 40 and the starter motor 41 and also wasting of the stored electric power can be prevented, even if the contact 45 of the magnet switch 40 remains closed or any trouble such as short-circuits or grounding faults happen inside the starter motor 41, by limiting the capacity of the subsidiary storage device 2 to such an amount (the capacity of power required for each normal starting) by which the starter motor 41 and the magnet switch 40 can be fed at a specified current for, for example, 10 seconds.

Figure 18:
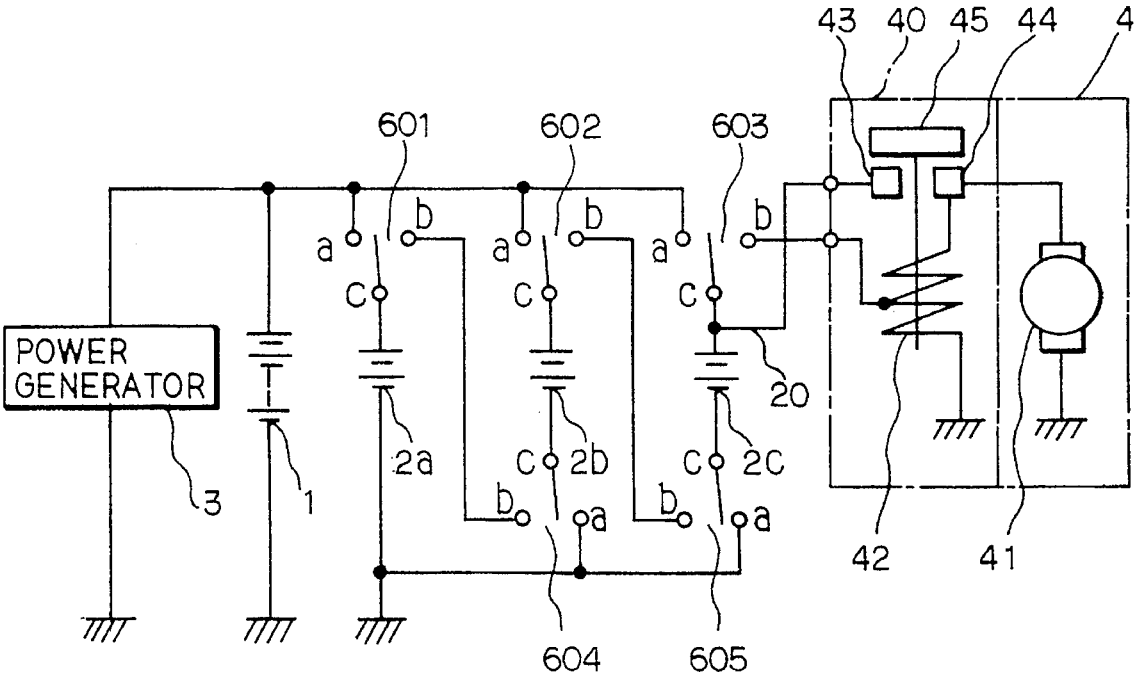
FIG. 18 is a circuit diagram illustrating an eighth embodiment according to the present invention.

The eighth embodiment will now be described with reference to FIG. 18.

Figure 4:
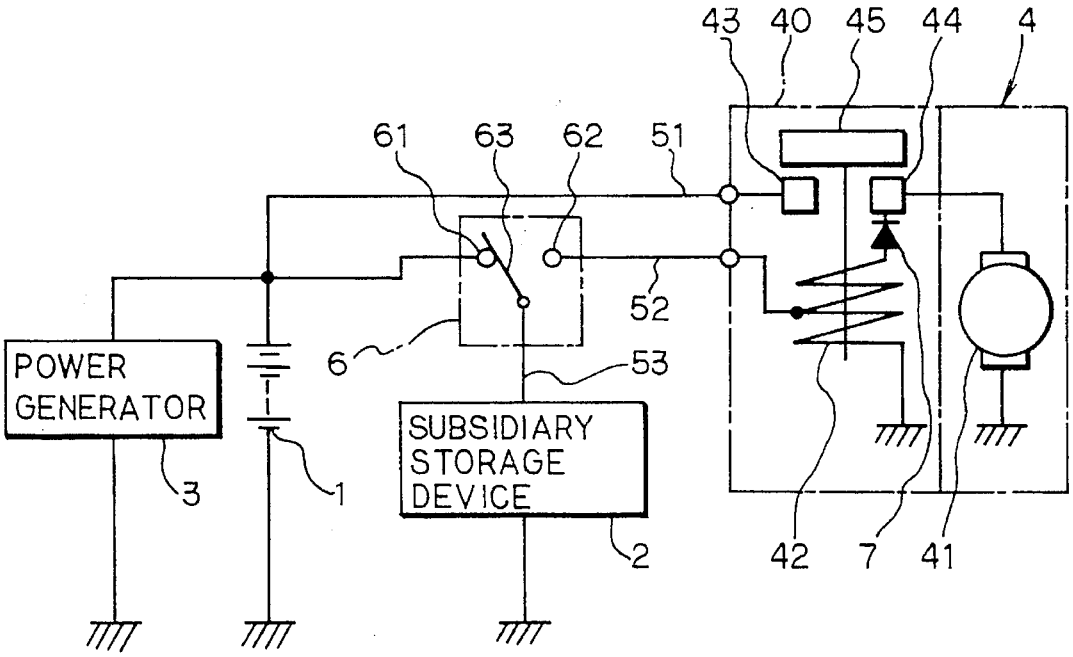
FIG. 4 is a circuit diagram illustrating a second embodiment according to the present invention.

This embodiment shows a modification of the embodiments illustrated in FIG. 4 and FIG. 7, in which the subsidiary storage device is divided into subsidiary storage devices 2a, 2b and 2c, the starting switch is replaced by starting switches 601 through 605, and the contact 43 of the magnet switch 40 is connected to the higher potential end 20 of the subsidiary storage device 2c so that the starter motor 41 is fed with electricity from the subsidiary storage device 2.

Naturally, the capacity of the subsidiary storage devices is limited to the amount by which the starter motor 41 and the magnet switch 40 can be fed with electricity at a specified current for, for example, 10 seconds (the volume of power required for each normal starting).

Such modification will provide an advantage as described below.

The starter motor 41 and the magnet switch 40 can be fed with electricity, by first shifting the starting switches 601 through 605 to contact "a" side to charge in parallel subsidiary storage devices 2a to 2c each of which is composed of electric double-layer condensers, and next, by shifting the starting switches 601 through 605 to contact "b" side to connect in series the subsidiary storage devices 2a to 2c. This allows the starter unit 4 to be fed with electricity at a high voltage without using the DC-DC converter (refer to FIG. 8). With the starter motor 41 being made to a small-current type, it is possible to make the commutator (not shown) smaller in size and reduce the heat produced.

Figure 19:
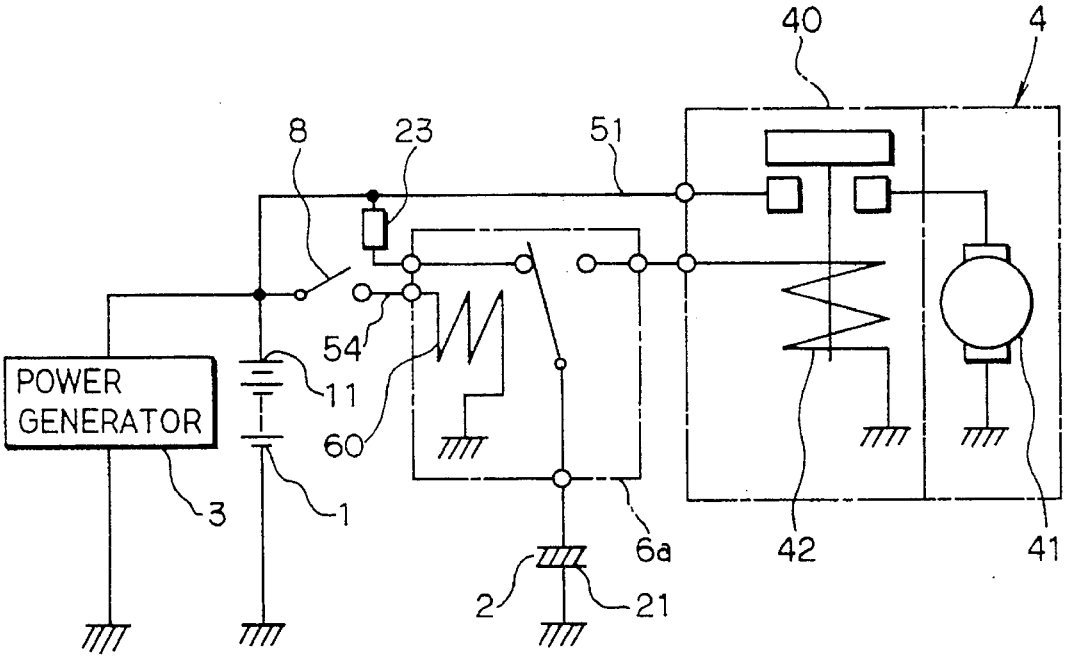
FIG. 19 is a circuit diagram illustrating a ninth embodiment according to the present invention.
Figure 20:
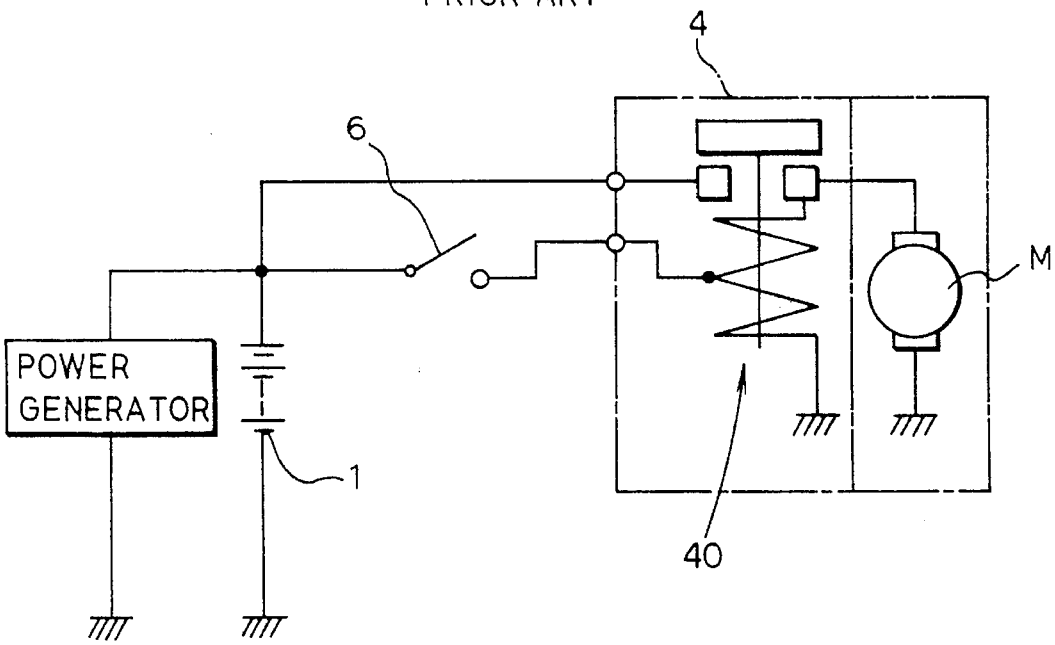
FIG. 20 PRIOR ART
FIG. 20 is a circuit diagram illustrating a conventional starting apparatus for vehicles.

The ninth embodiment will be now described with reference to FIG. 19.

In this embodiment, the resistor 23 (illustrated in FIG. 3) is provided between the higher potential end 11 of the battery 1 and the relay switch 6a for setting the time constant of charging by the magnet switch 40 of one-coil configuration applied in the fourth embodiment.

This allows the subsidiary storage device 2 to be composed only of the electric double-layer condenser 21 as is in the third embodiment, and the diodes 22 and 25 illustrated in FIG. 3 thus be eliminated. The circuit structure of this embodiment can be, of course, applied to the magnet switch 40 of 2-coil configuration applied in the second embodiment.

The preferred aspects of the present invention will now be summarized as follows;

(a) a starting apparatus for vehicles, in which the subsidiary storage device has a capacity enough to store the power required for each engine starting;

(b) a starting apparatus for vehicles, in which the subsidiary storage device is integrated with the starter unit;

(c) a starting apparatus for vehicles, in which the period of discharge from the time said subsidiary storage device starts discharging to the time the terminal voltage of the subsidiary storage device falls below the contact reset voltage (restorative voltage) of the coil of the magnet switch is determined to be shorter than the period of time from the time the discharge starts to the time the temperature of any given part of the magnet switch or the starter motor reaches a burning temperature;

(d) a starting apparatus for vehicles, in which the period of charging from the time the subsidiary storage device starts to be charged to the time the terminal voltage of the subsidiary storage device reaches above the contact closing voltage of the coil of the magnet switch is determined to be longer than the period of time from the time the discharge stops to the time the number of revolutions of the starter motor falls below a specified safe number of revolutions;

(e) a starting apparatus for vehicles, in which the coil of the magnet switch is composed of two-terminal type coil;

(f) a starting apparatus for vehicles, in which the starting switch is composed of a transfer switch which has common contact connected to the subsidiary storage device, charging contact connected to the main storage device, and the discharging contact connected to the coil of the magnet switch;

(g) a starting apparatus for vehicles, in which the subsidiary storage device constitutes an exclusive power source for feeding electricity to the magnet switch and the starting motor; and (h) a starting apparatus for vehicles, in which the subsidiary storage device is integrated with said magnet switch and the starter motor.

What is claimed is:

1. A starting apparatus for vehicles having an electric power generating device, said starting apparatus comprising:

a starter unit, including a starter motor capable of starting an engine and a magnet switch, for supplying and stopping an electric current supply to said starter motor;

a subsidiary storage device connected to drive said starter unit and having a storage capacity smaller than a value which may cause damage to said starter unit when a current is continuously discharged therefrom to said starter unit but larger than that required for each starting of said engine;

a main storage device which feeds electricity to said subsidiary storage device during engine non-starting time; and starting means for discharging electric power stored in said subsidiary storage device to said starter unit at engine starting time to feed an electric current to at least said magnet switch, and for passing the current stored in said main storage device for charging said subsidiary storage device during engine non-starting time;

wherein said subsidiary storage device includes first means for allowing only the current from said starting means, charging means connected in series with said first means for being charged by said current, holding means connected in parallel with said charging means for holding a charging voltage from said charging means to a specified value, and second means connected in series with said holding means for allowing only a discharging current from said charging means.

2. A starting apparatus for vehicles according to claim 1, wherein said starter unit comprises:

an exciting coil which produces a magnetic field by the current passed thereto from said subsidiary storage device;

a moving contact attracted by the magnetic field; and a fixed contact which contacts by the attraction of said moving contact.

3. A starting apparatus for vehicles according to claim 1, wherein a resistor for deciding a charging time constant at charging is provided between said generating device and said starting means, and said subsidiary storage device includes an electric double-layer condenser.

4. A starting apparatus for vehicles according to claim 1, wherein a DC-DC converter is connected to said first means.

5. A starting apparatus for vehicles according to claim 1, wherein said subsidiary storage device is integrated with said magnet switch and said starter motor.

6. A starting apparatus for vehicles according to claim 1, wherein said starting means includes:

relay drive type switching means for opening and closing to pass and cut off an electric current; and switching means for feeding and interrupting electric current from said main storage device and which is provided between said relay drive type switching means and said main storage device.

7. A starting apparatus for vehicles having an electric power generating device, said starting apparatus comprising:

a starter unit, including a starter motor capable of starting an engine and a magnet switch, for supplying and stopping an electric current supply to said starter motor;

a subsidiary storage device connected to drive said starter unit and having a storage capacity smaller than a value which may cause damage to said starter unit when a current is continuously discharged therefrom to said starter unit but larger than that required for each starting of said engine;

a main storage device which feeds electricity to said subsidiary storage device during engine non-starting time; and starting means for discharging electric power stored in said subsidiary storage device to said starter unit at engine starting time to feed an electric current to said magnet switch, and for passing the current stored in said main storage device for charging said subsidiary storage device during engine non-starting time;

wherein said starter unit includes:

an exciting coil which produces a magnetic field by the current passed thereto from said subsidiary storage device;

a moving contact attracted by the magnetic field; and a fixed contact which contacts by the attraction of said moving contact, and wherein said magnet switch includes reversing means for preventing a current from flowing from said fixed contact to said exciting coil.

8. A starting apparatus for vehicles, said starting apparatus comprising:

a selection switch selectively actuated to first and second positions for starting and non-starting a vehicle engine, respectively;

a storage battery connected to said selection switch;

a starter unit including a starter motor and a magnet switch for energizing said starter motor during closure thereof; and a capacitor connected to said selection switch to be charged by said storage battery when said selection switch is in said second position, and which energizes only an exciting coil of said magnet switch and discharges to close said magnet switch when said selection switch is in said first position, capacitance of said capacitor being so determined that said magnet switch is opened irrespective of said selection switch in said first position when discharge of said capacitor continues for a predetermined time by which said starter motor is prevented from excessive heat generation due to continued energization.

9. A starting apparatus for vehicles having an electric power generating device, said starting apparatus comprising:

a main storage device;

a starter motor capable of starting a vehicular engine;

a magnet switch, having a magnetic coil, for supplying electric current from said main storage device to said starter motor responsive to a closure of said magnet switch;

a subsidiary storage device for supplying electric current to the magnetic coil of said magnet switch and which has a storage capacity for storing electric power needed to keep said magnet switch actuated for a predetermined period of time which is shorter than a time for said main storage device to continuously energize said starter motor until the latter may become damaged and longer than that required for each starting of said engine; and starting means for discharging electric power stored in said subsidiary storage device to said magnetic coil of said magnet switch to close the magnet switch, thereby starting said engine by supplying electric current from said main storage device to said starter motor during engine starting time, and for passing the current stored in said main storage device for charging said subsidiary storage device during engine non-starting time.

10. A starting apparatus for vehicles according to claim 9, wherein said subsidiary storage device comprises:

first means for allowing only the current from said starting means;

charging means connected in series with said first means for being charged by said current;

holding means connected in parallel with said charging means for holding a charging voltage from said charging means to a specified value; and second means connected in series with said holding means for allowing only a discharging current from said charging means.

11. A starting apparatus for vehicles according to claim 10, wherein a DC-DC converter is connected to said first means.

12. A starting apparatus for vehicles according to claim 9, wherein said magnet switch comprises:

an exciting coil which produces a magnetic field when energized;

a moving contact attracted by said magnetic field;

a fixed contact which comes into contact with said moving contact when the latter is attracted; and reverse flow prevention means disposed between said exciting coil and said moving contact for preventing a reverse current from flowing from said fixed contact to said exciting coil.

13. A starting apparatus for vehicles according to claim 9, wherein a resistor for setting a charging time constant at charging is provided between said generating device and said starting means, and said subsidiary storage device includes an electric double-layer condenser.

14. A starting apparatus for vehicles according to claim 9, wherein said starting means includes:

relay drive type switching means for opening and closing to pass and cut off an electric current; and switching means for feeding and interrupting electric current from said main storage device and which is provided between said relay drive type switching means and said main storage device.

15. A starting apparatus for vehicles according to claim 9, wherein said subsidiary storage device is integrated with said magnet switch and said starter motor.

16. A starting apparatus for a vehicle, said apparatus comprising:

a main storage device;

a subsidiary storage device;

starter motor;

a magnet switch having a first contact connected to said main storage device, a second contact connected to said starter motor, and a magnetic coil for selectively establishing and breaking an electrical connection between said first and second contacts; and a starting switch, connected to said subsidiary storage device and said magnetic coil of said magnet switch, for selectively applying electrical energy from said subsidiary storage device to said coil of said magnet switch, thereby closing said first and second contacts to establish an electrical connection between said main storage device and said starter motor responsive to application of said electrical energy from said subsidiary storage device to said starting switch.

17. The circuit of claim 16, wherein said subsidiary storage device supplies electrical energy to said magnetic coil for a time period sufficient for said main storage device to actuate said starter motor but insufficient for said main storage device to damage said starter motor.

18. An electrical circuit comprising:

a main storage device;

a subsidiary storage device;

a load;

a first switch having a first contact connected to said main storage device, a second contact connected to said load, and a coil for selectively establishing and breaking an electrical connection between said first and second contacts; and a second switch, connected to said subsidiary storage device and said coil of said first switch, for selectively applying electrical energy from said subsidiary storage device to said coil of said first switch, thereby closing said first and second contacts to establish an electrical connection between said main storage device and said load responsive to application of said electrical energy from said subsidiary storage device to said second switch, wherein said second switch is further for establishing an electrical connection between said main storage device and said subsidiary storage device when not establishing said electrical connection between said main storage device and said load.

19. The circuit of claim 18, wherein said main storage device charges said subsidiary storage device, when said second switch establishes said electrical connection therebetween, at a rate which renders said subsidiary storage device incapable of causing said coil to establish said electrical connection between said first and second contacts for a predetermined time period.

20. A method of powering an electrical load, said method comprising the steps of:

charging a subsidiary storage device using a main storage device; and applying, when not performing said charging step, electrical energy from said subsidiary storage device to a coil of a magnetic switch to cause said magnetic switch to establish an electrical connection between said main storage device and said load, thereby powering said electrical load.

21. The method of claim 20, further comprising the step of selectively moving a switch between first and second positions to perform said charging and applying steps.

22. The method of claim 20, further comprising the step of performing said applying step for a predetermined amount of time which is sufficient to actuate said electrical load but insufficient to cause damage to said electrical load.

23. The method of claim 20, wherein said charging step comprises a step of charging said subsidiary storage device at a rate insufficient to cause said magnetic switch to establish said electrical connection between said main storage device and said electrical load for a predetermined time period.

* * * * *